United States Patent [19]

Kobelt

[11] 4,391,182

[45] Jul. 5, 1983

[54] FLUID ACTUATED POSITIONER

[76] Inventor: Jacob Kobelt, 6110 Oak St., Vancouver, British Columbia, Canada, V6M 2W2

[21] Appl. No.: 173,279

[22] Filed: Jul. 29, 1980

[51] Int. Cl.[3] ..... F15B 9/10; F15B 15/17

[52] U.S. Cl. ..... 91/378; 91/376 R; 91/416; 91/417 R

[58] Field of Search ..... 91/416, 417 R, 376 R, 91/378

[56] References Cited

U.S. PATENT DOCUMENTS

| | | | |
|---|---|---|---|
| 2,413,287 | 12/1946 | Bush | 91/417 R |
| 2,413,380 | 12/1946 | Rush et al. | 91/417 R |
| 2,909,157 | 10/1959 | Reis | 91/417 R |
| 3,044,451 | 7/1962 | Morrison | 91/416 |
| 3,646,849 | 3/1972 | Smith | 91/416 |

FOREIGN PATENT DOCUMENTS

| | | | |
|---|---|---|---|
| 1333742 | 10/1973 | United Kingdom | 91/376 R |

*Primary Examiner*—Paul E. Maslousky

*Attorney, Agent, or Firm*—Carver & Co.

[57] ABSTRACT

A fluid actuated positioner for producing a mechanical output signal proportional to a fluid input signal. Input signal acts on input rod of input cylinder to control a main valve which controls flow between chambers of a hydraulic power cylinder. Power cylinder has output piston rod connected to device to be controlled, and fluid forces on output rod are determined by pressure differences across faces of output piston, which differences are determined by amount of metering of main valve. Valve can be simple clearance passage maintained open to permit steady flow therethrough in non-changing signal, or can be spool valve which stops flow during non-changing. Both devices do not require exceptionally close tolerance manufacture, and creep problems are reduced.

10 Claims, 4 Drawing Figures

FLUID ACTUATED POSITIONER

BACKGROUND OF THE INVENTION

1. Field of the Invention

The invention relates to a fluid actuated positioner or servo device for converting a relatively low pressure fluid signal into a magnified mechanical force, particularly for use in a marine control system.

2. Prior Art

For many years pneumatic or hydraulic controls have been used in the marine industry for control of many devices, for example engine throttle controls, gear box/clutch controls and numerous other applications. Commonly the signal is a varying pressure pneumatic signal, or a direct mechanical movement from a manual control. The signal, by itself, would commonly have insufficient force to operate the apparatus to be controlled. The force must be magnified, and commonly this has been done using pressurized hydraulic fluid through a servo device. Many devices are available for this purpose, a particular device being found in the present inventor's U.S. Pat. No. 3,496,833 issued 1970. This device uses a mechanical input signal which is magnified by a pressurized hydraulic servo device. More typical devices are found in U.S. Pat. Nos. 3,757,640 (Karol); 3,502,001 (Moore) and 4,089,252 (Patel et al). Some of these patents disclose devices in which input force is mechanical or fluid actuated, and most of them use the force multiplying effects of pressurized hydraulic fluid acting on a piston/cylinder combination.

In general, many of the devices of the prior art perform satisfactorily in some situations but are not easily adaptable to the wide range of applications required in marine situations. Specifically some devices of the prior art require highly accurate manufacturing tolerances, thus are costly to produce with corresponding high maintenance expense. Also, close tolerances produce difficulties in alignment of the device in a typical installation, and sometimes difficulties can arise in installations where the apparatus cannot tolerate a wide range of input forces without a corresponding loss of accuracy. In other instances, a change in output force requires a proportionately greater change in input forces to "unstick" a valve, etc., and this tends to "over shoot" the desired setting. Thus the change in input signal is exagerated and then the control must be backed off in an attempt to obtain the desired setting. Some devices also experience "creep" and cannot maintain a desired setting for any length of time.

SUMMARY OF THE INVENTION

The invention reduces some of the difficulties and disadvantages of the prior art by providing a relatively simple device which is compact, and can be manufactured relatively inexpensively within normal manufacturing tolerances. Thus the device does not require highly accurate manufacturing as required by some prior art devices. Furthermore, the device can tolerate a relatively wide range of fluid input pressures and can be reset to accommodate a wide range of average pressures. In a preferred embodiment, which uses a continuous low volume flow of hydraulic fluid, changes in output force accurately reflect relatively small changes in the input force with little tendency to creep, and without the requirement to exaggerate the input signal to obtain a desired output signal. In an alternative embodiment, continuous hydraulic flow is not required. A small exaggerated change in input force is all that is required to cause a corresponding change in output force.

A fluid actuated positioner according to the invention produces a mechanical output signal proportional to a fluid input signal and has an input cylinder, an output cylinder, and a main control valve. The positioner is adapted to receive a working fluid of constant pressure and to produce the output signal from a signal fluid of varying pressure. The input cylinder has input partition means dividing the cylinder into first and second input chambers and an input rod mounted on the partition means for movement axially of the cylinder. The first input chamber receives signal fluid under a varying pressure which generates a varying input signal on the input rod. Resilient means cooperate with the input rod to oppose the input signal on the input rod, the input rod being essentially unaffected by any contact with the working fluid. The output cylinder has an output member with an output partition means and an output rod, the output partition means dividing the output cylinder into first and second output chambers. The output partition means has first and second faces within the respective output chambers and the output rod mounts the output partition means for movement axially of the output cylinder. The first output chamber receives working fluid under a constant pressure which generates a first force on the output partition means. The output rod extends from the output partition means through the first output chamber so that the first face has a smaller effective area than the second face. A fixed metering means is disposed between exhaust and the second output chamber to control flow of working fluid therefrom prior to exhausting the working fluid. The main control valve communicates with the first and second output chambers and has first and second valve portions fixed relative to and movable with the output member and input rod respectively. Thus, relative positions of the output member and the input rod reflect cooperation between the first and second valve portions so as to control flow of working fluid from the first output chamber into the second output chamber prior to exhausting the working fluid from the positioner. The first valve portion is a connecting bore within the output member, the connecting bore communicating with the first output chamber. The second valve portion is a portion of the input rod which cooperates with the connecting bore to control fluid flow therethrough, the relative positions of the first and second valve portions thus control metering of a continuous flow of working fluid passing between the first and second valve portions. The working fluid in the second output chamber generates a second force on the second face in opposition to the first force to produce on the output rod a resultant displacement proportional to the input signal.

A detailed disclosure following, related to drawings, describes the preferred embodiment of the invention which is capable of expression in structure other than that particularly described and illustrated.

DETAILED DISCLOSURE

Figure 1:
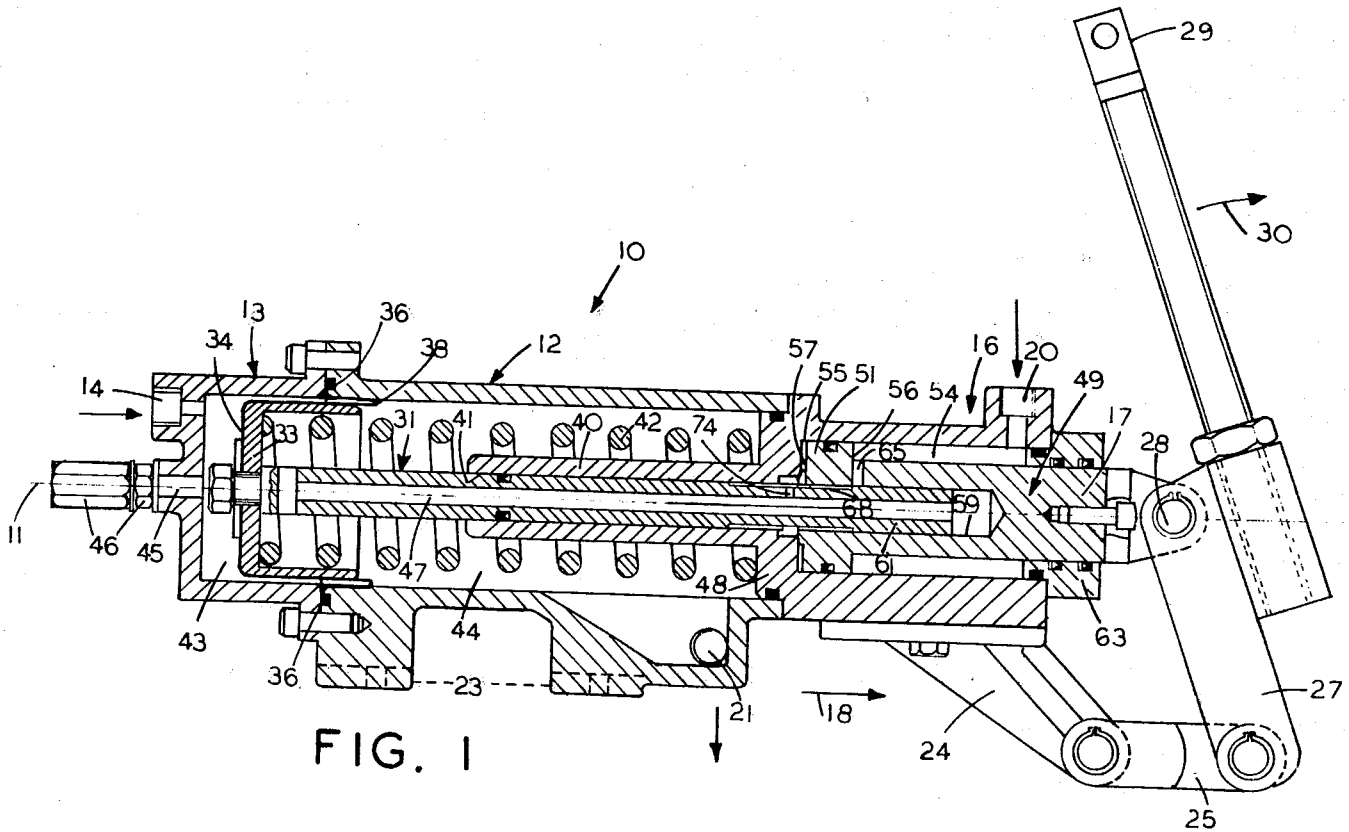
FIG. 1 is a simplified fragmented section of a fluid actuated positioner according to the invention.
Figure 2:
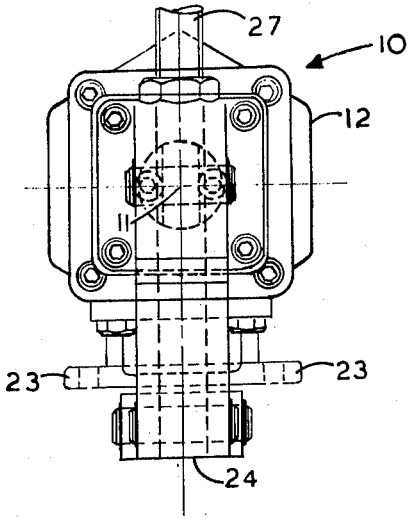
FIG. 2 is an end elevation of the positioner.
Figure 3:
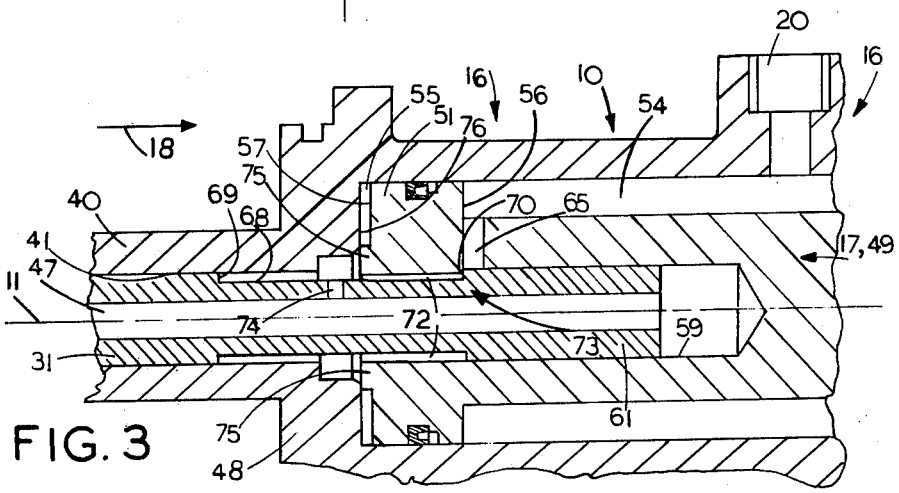
FIG. 3 is a simplified fragmented section at an enlarged scale of a main flow control valve of the invention.
Figure 4:
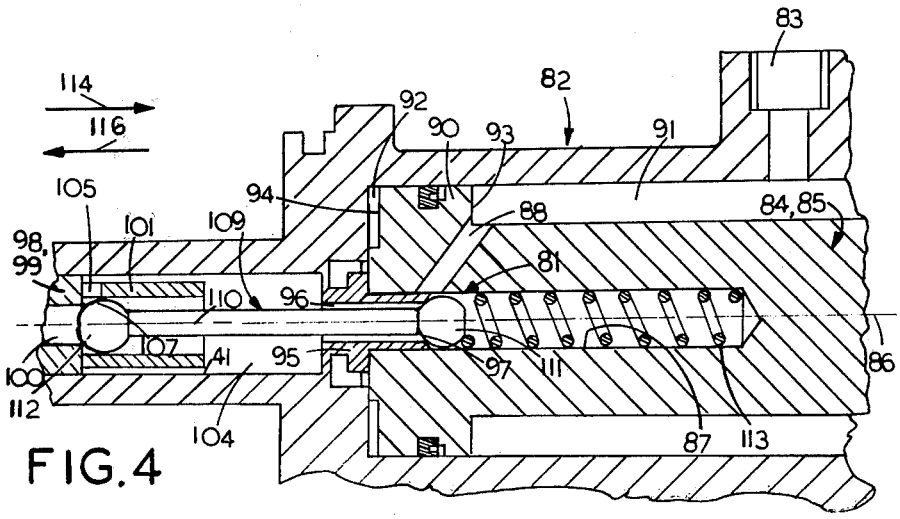
FIG. 4 is a simplified fragmented section of an alternative main flow control valve.

FIGS. 1 through 3

Referring mainly to FIG. 1, a fluid actuated positioner 10 has a main body 12 having an input cylinder 13 within an input port 14 to receive a signal fluid, eg. air under pressure, representing an input signal. The positioner has an output cylinder 16 with an output rod 17 which is extensible and retractable relative to the cylinder along a central axis 11 thereof per arrow 18. The output cylinder has a hydraulic fluid input port 20 receiving working fluid, eg. hydraulic fluid under pressure from a hydraulic power pack, not shown, and the input cylinder 13 has a hydraulic fluid exhaust port 21 discharging hydraulic fluid to a sump, not shown. Mounting brackets 23, broken outline, are used to mount the positioner on a suitable surface as required. An output bracket 24 hinges a coupling link 25 at an outer end thereof, the coupling link being hinged to one end of an output lever 27 which is hinged on a main journal pin 28 carried at an outer end of the output rod 17. It can be seen that extension on the output rod 17 in direction of the arrow 18 swings the output lever 27 per arrow 30, a connecting member, not shown, being hinged at an end 29 of the lever 27 to cooperate with an apparatus to be moved by the positioner, position of the end 29 of the output lever being variable for a particular installation requirement as is common practice.

The input cylinder 13 has an input rod 31 extending concentrically of the central axis 11 and carrying a cap 33 and flexible impermeable diaphragm 34 as shown. The diaphragm has an outer periphery secured at 36 and an annular fold 38 permits the cap 33, with the rod 31, to reciprocate within the cylinder as in a conventional rolling diaphragm air cylinder. The positioner has a boss 40 having a mounting bore 41 to mount the input rod for axial sliding, and a compression coil spring 42 encircles the rod and boss tending to force the cap 33 towards an outer end space of the input cylinder 13. Undesignated seals are fitted as required and it can be seen that the diaphragm 34 serves as an input partition means and divides the cylinder into first and second input chambers 43 and 44 on opposite sides thereof. A dividing wall 48 separates the input and output cylinders 13 and 16, carries the boss 40 and has a bore aligned with the mounting bore 41 to permit the input rod to pass into the output cylinder as shown. The input rod thus mounts the partition means for movement axially of the cylinder. The first input chamber 43 receives input signals, that is air, under pressure through the input port 14, which generates an input signal on the input rod proportional to the signal pressure in direction of the arrow 18. The input rod has a central exhaust conduit 47 extending therealong so as to discharge into the second input chamber 44 as will be described. A threaded adjusting shaft 45 is fitted adjacent an outer end of the input cylinder 13 to permit adjustment of the amount of preload of the spring 42 on the input rod 31. A pair of locking nuts 46 are threaded on the shaft 45 to lock the shaft at a particular location to maintain the desired preload of the spring.

The output rod 17 of the output cylinder 16 is a portion of an output member 49 which carries an output piston 51 which is sealed for sliding within the cylinder 16. The piston divides the output cylinder into first and second output chambers 54 and 55, the output piston having first and second faces 56 and 57 within the respective output chambers. The second output chamber and the second input chamber are thus adjacent each other and are separated by the dividing wall. Also, the spring 42 extends between the input partition means and the dividing wall within the second input chamber. The output rod 17 extends from the output piston through the first chamber 54 so that the first face has a smaller effective area than the second face. The rod 17 has a central bore 59 to accept an inner end 61 of the input rod 31 as a sliding fit therein, and sealed bearings 63 mount the output rod 17 for movement axially of the output cylinder.

As best seen in FIG. 3, the output rod 17 has a transverse connecting bore 65 connecting the first output chamber 51 with the central bore 59. The input rod 31 has a clearance portion 68 of reduced diameter defined in part by first and second shoulders 69 and 70. The portion 68 is cylindrical and has a cross section reduced from cross section of the rod by an amount of the annular shoulders, and thus an annular space 72 is defined between the clearance portion and side wall of the main bore 59 of the output member. The space 72, with the bore 65, provide communication between the first and second output chambers. Stops 75 between the second face 75 and an opposite face 76 of the second chamber maintain a gap between the two faces to admit fluid into the second chamber 55. A transverse metering bore 74 extends through the input rod 31 adjacent the clearance portion 68 to provide communication between the second output chamber 65 and the exhaust conduit 37.

OPERATION

In operation the varying pressure air signal is supplied to the input ports 14 and hydraulic fluid is fed under pressure into the input port 20 and leaves through the exhaust port 21. The hydraulic fluid enters the first output chamber 54 and then passes through the connecting bore 65 to pass along the clearance portion and into the second output chamber 55. Fluid leaves the second output chamber through the metering bore 74 at a rate determined by pressure and the size of the bore 74, and flows along the exhaust conduit 47 to discharge into the second input chamber 44 and leave by the exhaust port 21.

The first output chamber 54 receives the working fluid under pressure which generates a first force on the output piston proportional to pressure of the fluid and area of the first face 56. As the fluid passes through the connecting bore 65 and along the annular space 72 it is metered and its pressure drops as it passes into the second output chamber 55. Working fluid within the second chamber generates a second force on the second face 57 which is proportional to the reduced fluid pressure and area of the face 54 and is in opposition to the first force. The two forces interact to produce on the output rod a resultant force proportional to the pressure and piston face area differences. The second face can have an area approximately twice that of the first face, and thus different amounts of metering of the fluid through the connecting bore can produce a resultant force in either direction. When the second force is greater than the first force, the output member 49 moves in the direction of the arrow 18, thus closing, or at least further reducing the gap between the shoulder 70 of the annular space 72 and the connecting bore 65. Reducing the gap increases metering of fluid flowing through the gap, which correspondingly reduces pressure in the second chamber 55. This reduction in pressure produces a corresponding reduction in the second force which causes the input member to shift in a direction opposite to the arrow 18. This slightly decreases metering of the fluid at the bore 65 which causes an increase in the pressure in the second output chamber 55 which shifts the output member and thus the bore 65, which correspondingly increases metering of the fluid. Thus the output member can attain a balanced position in which the first and second forces are maintained equal assuming all other remain constant. It can be seen that this balancing is automatic and is relatively tolerant to manufacturing errors in the fit of the input rod and other components. Thus the resultant force on the output rod producs a resultant displacement of the output lever 27, ie. an output signal, until the balanced condition is attained, which displacement is proportional to the input signal.

It can be seen that the second shoulder 70 and the associated clearance portion 68 cooperate with the connecting bore 59 to form a main control valve 73 to control flow of working fluid from the first output chamber to the second output chamber. The connecting bore defines in part a first valve portion associated with the output member, and the shoulder 70 and associated clearance 68 is considered to be a control surface defining in part a second valve portion associated with the input rod. The second valve portion thus cooperates with the first valve portion to determine, in part, the flow of working fluid through the main control valve into the second output chamber. It can therefore be seen that the main control valve 73 communicates with the first and second output chambers and has first and second valve portions fixed relative to and movable with the output member and the input rod respectively. In this way, relative positions of the output member and the input rod reflect cooperation between the first and second valve portions so as to control flow of working fluid through the valve. The metering bore 74 communicates with the exhaust conduit 47 and the space 72 of the clearance portion to meter discharge of working fluid from the second output chamber into the second input chamber 44, prior to exhaust from the second input chamber through the exhaust port. The metering bore 74 thus is defined as metering means communicating with the second output chamber to control flow of fluid therefrom prior to exhausting the working fluid, and is in fact a major parameter in controlling response of the positioner, assuming variables such as the hydraulic fluid supply remains constant.

The above discussion assumed a constant input signal applied to the input port 14. If the input pressure is increased, input force on the input rod is increased in proportion to the input signal, and the compression spring 42 compresses to permit the input rod to move into the main bore 59 of the output member. This disturbs the stable flow condition through the connecting bore 59. The shoulder 70 moves in direction of the arrow 18, increasing clearance through the valve 73 and thus decreasing metering of the fluid and thus increasing fluid pressure in the second output chamber 55. This increases force on the output member which moves correspondingly in the direction of the arrow 18 until the stable position is again reached relative to the fluid flow. Thus the main control valve, termed flow control means, is responsive to the input signal and, in effect, communicates with the first and second output chambers to control flow of working fluid from the first output chamber into the second output chamber prior to exhausting the working fluid from the positioner.

It can be seen that the variables associated with this apparatus can be changed easily to attain selected sensitivity, or range of movement suitable to cope with the range of input signal pressures. The amount of preload of the spring 42 can be changed by adjusting the shaft 45, or if required, the spring can be changed to attain a different sensitivity. Metering bore 74 can be made larger or smaller to accommodate different hydraulic fluid supply. Clearly a wide range of adjustment is attainable on the output lever. Also the input rod is essentially unaffected by contact with the working fluid. As this is a continuous flow device, with a constant working fluid pressure, creep problems are virtually eliminated. If the output lever is required to position a device requiring a relatively high force, it is a relatively simple matter to increase the working pressure, or to change the characteristics of the valve or area ratios between the first and second faces of the output partition means.

ALTERNATIVES AND EQUIVALENTS

As described, the input cylinder has a rolling diaphragm to serve as an input partition means between the input fluid and working fluid. This is preferrable for most situations as leakage problems are essentially eliminated assuming the diaphragm can tolerate contact with the signal fluid and the hydraulic fluid. Alternative input partition means can be substituted, such as a sliding piston with cup seals for other applications. Also, the output cylinder is shown with a piston and sliding cup seals, and clearly alternative output partition means can be substituted, for example, different seals or diaphragm arrangement.

FIG. 4

An alternative main control valve 81 is substituted for the valve 73 of FIGS. 1–3. An alternative output cylinder 82 has a fluid input port 83, and an output member 84 with an output rod 85 having an outer portion cooperating with a hinged output lever, not shown, in a manner similar to the device 10 of FIGS. 1–3. The output rod 85 has a main bore 87 concentric with an axis 86 of the device, and an inclined connecting bore 88 extending into the main bore 87, which contrasts with the transverse connecting bore 65 of FIG. 1. A metering sleeve 95 having a control bore 96 smaller than the bore 87 is fitted adjacent an inner end of the output member 84 and has a control bore valve seat 97 adjacent the connecting bore 86. Thus the output member 84 has a connecting bore communicating with the first output chamber, and a control bore having a control bore valve seat connecting the first and second output chambers. The output member 84 has an output piston 90 which divides the output cylinder into first and second output chambers 91 and 92, and has first and second faces 93 and 94 having similar area ratios as previously described. An alternative input rod 98 is generally similar to the input rod 81 of FIGS. 1–3 and has an exhaust conduit 100 and an inner end 99 having a clearance portion 101 of less diameter than the mounting bore 41 of the boss 40. The exhaust conduit discharges into the second input chamber 44, FIG. 1, and via the exhaust port 21 to discharge fluid from the positioner. The rod 98 has a transverse discharge bore 105 extending between the clearance portion and a valve seat 107 adjacent the inner end 99 thereof. The positioner has the mounting bore 41 to mount the input rod 98 for axial sliding relative thereto, an end space 104 of the bore 41 providing communication between the exhaust conduit 100 and the second output chamber 92.

A spool valve 109 has a spool body portion 110 connecting spaced-apart first and second spool portions 111 and 112 as shown. The body portion connects the spool portions rigidly together and spaced apart, and is smaller than the spool portions and control bore 96 to provide clearance for working fluid that flows passed the spool portion. The body portion extends through the control bore, and is of such a length that an inner portion of the first spool portion 111 controls the control bore by sealing against the valve seat 97, and an outer portion of the second spool portion 112 seals against the valve seat 107 and controls flow in the exhaust conduit 100. A return spring 113 extends between the spool portion 111 and an opposite end of the main bore 87 to force the spool valve against the control bore valve seat 97. Alternative locations of the spring 113 are envisaged.

In operation, working fluid under pressure is fed into the input port 83 flows into the first output chamber 91, through the connecting bore 88 and into the main bore 87. The spool portion 111 seals the control bore 96 by being held against the seat 97 by the fluid, and the spool portion 112 seals the exhaust conduit 100 by sealing against the seat 107. Thus flow through the control bore and exhaust conduit is prevented, thus providing a stable position until disturbed. When an input signal acts in direction of an arrow 114 on the input rod 98, the valve seat 107 moves in the same direction and moves the valve member 109 to displace the spool portion 111 from the seat 97. This permits working fluid to pass through the control bore 96 into the space 104, thence into the second chamber 92. Similarly to the first device, working fluid in the first output chamber 91 generates a first force on the output piston, and working fluid in the second output chamber generates a second force on the second face in opposition to the first force on the second face in opposition to the first force to produce a resultant force which shifts the output member in the direction of arrow 114. The output member moves in that direction until the spool portion 111 contacts the valve seat 97 to close the control bore 96 thus preventing further flow. It can be seen that the output member has moved an amount proportional to the movement of the input rod and that when the stable position is reached, further flow into the output chamber is prevented. Again both valve seats 97 and 107 are closed by the respective spool portions.

In a reverse situation, the input rod 98 moves in an opposite direction as shown by an arrow 116. The spool portion 112 is lifted off the exhaust valve seat 107 and fluid from the second output chamber then can pass through the space 104, through the transverse bore 105 and out through the exhaust conduit 100 to the second input chamber, FIG. 1, and then out through the exhaust port 21. This reduces the fluid pressure in the second output chamber and the output chamber 84 can move in the direction of the arrow 116, thus moving concurrently the valve spool 109 in the same direction. When the spool portion 112 contacts the seat 107, the exhaust conduit 100 is closed thus preventing further flow, the spool portion 111 similarly sealing the valve seat 97.

It can be seen that the valve seat 97 defines in part a first valve portion of the main control valve 81, and the spool valve 109 defines the second valve portion and is, in effect, a valve member cooperating with input rod and the control bore seat 97 to control working fluid flow therethrough from the first output chamber to the second output chamber. The second spool portion can be seen to cooperate with the exhaust conduit to control flow of working fluid from the second chamber to exhaust. It can be seen that the connecting bore 88 is positioned so that when the first spool portion is lifted off the control bore seat by the input rod, the connecting bore passes fluid through the control conduit into the second output chamber.

It can be seen that the main control valve 81 functions generally equivalently to the main control valve 73 of FIG. 1. The valve 81 differs from the valve 73 in that when the stable position is reached, additional hydraulic fluid cannot flow into the input port because the control bore is closed by the spool valve 109. However, it can be appreciated that, before the spool valve can move, an additional movement is required to "unstick" the valve spool from the respective seat. Thus the alternative valve means requires a somewhat exaggerated input force to shift the valve member to commence fluid flow into the first output chamber. This means that response of the alternative embodiment is somewhat slower than that of the first embodiment, but it has advantage that a continuous flow of hydraulic fluid is not required. Similarly to the first embodiment, exceptionally close manufacturing tolerances are not required, and minor working fluid leakage passed the valve seats is acceptable, and may be desirable in some instances.

I claim:

1. A fluid actuated positioner adapted to receive a working fluid of constant pressure and to produce a mechanical output signal proportional to a fluid input signal from a signal fluid of varying pressure, the positioner having:

(a) an input cylinder having input partition means dividing the cylinder into first and second input chambers, an input rod mounting the partition means for movement axially of the cylinder, the first input chamber receiving the signal fluid under varying pressure which generates a varying input signal on the input rod, and resilient means cooperating with the input rod to oppose the input signal on the input rod, the input rod being essentially unaffected by contact with the working fluid, (b) an output cylinder having an output member with an output partition means and an output rod, the output partition means dividing the output cylinder into first and second output chambers, the output partition means having first and second faces within the respective output chambers, the output rod mounting the output partition means for movement axially of the output cylinder, the first output chamber receiving the working fluid under a constant pressure which generates a first force on the output partition means, the output rod extending from the output partition means through the first output chamber so that the first face has a smaller effective area than the second face, and a fixed metering means disposed between exhaust and the second output chamber to control flow of working fluid therefrom prior to exhausting the working fluid, (c) a main control valve communicating with the first and second output chambers and having first and second valve portions, the first valve portion being a connecting bore within the output member, the connecting bore communicating with the first output chamber, and the second valve portion being a portion of the input rod which cooperates with the connecting bore to control fluid flow therethrough, so that relative positions of the output member and the input rod control metering of a continuous flow of working fluid passing between the first and second valve portions so as to control flow of working fluid from the first output chamber into the second output chamber prior to exhausting the working fluid from the positioner, so that the working fluid in the second output chamber generates a second force on the second face in opposition to the first force to produce on the output rod a resultant displacement proportional to the input signal.

2. A fluid actuated positioner as claimed in claim 1 in which:

(a) the output member has a main bore and the connecting bore communicates with the main bore, (b) the input rod has a clearance portion defined in part by spaced apart first and second shoulders, one of which shoulders defines a portion of the control surface of the second valve portion, the input rod being accepted in the main bore of the output member for relative movement therebetween, a space being defined between the clearance portion and side wall of the main bore which provides communication between the first and second output chambers.

3. A fluid actuated positioner as claimed in claim 2 in which:

(a) the positioner has a mounting bore to mount the input rod for axial sliding, (b) the input rod has an exhaust conduit communicating with the second input chamber, and the metering bore communicates with the exhaust conduit and the clearance portion to serve as the metering means and to discharge working fluid from the second output chamber into the second input chamber prior to exhaust from the second input chamber.

4. A fluid actuated positioner as claimed in claim 1 in which the input partition means is a rolling diaphragm having an outer periphery secured to the cylinder and an inner portion mounted on the input rod, an annular fold in the diaphragm permitting reciprocation of the rod within the cylinder.

5. A fluid actuated positioner as claimed in claim 1 in which the output partition means is a output piston which is sealed for sliding within the output cylinder.

6. A fluid actuated positioner as claimed in claim 1 in which the signal fluid is a gas and the working fluid is a hydraulic fluid.

7. A fluid actuated positioner as claimed in claim 1, or 2 in which:

(a) the means cooperating with the input rod to oppose the input signal includes a compression coil spring.

8. A fluid actuated positioner as claimed in claim 1, or 2 further including:

(a) a dividing wall with a bore, the wall separating the input and output cylinders, (b) a boss mounted on the dividing wall and having a mounting bore aligned with the bore in the dividing wall to mount the input rod for axial sliding therein.

9. A fluid actuated positioner as claimed in claim 8 in which:

(a) the second output chamber and the second input chamber are adjacent each other and are separated by the dividing wall, (b) the means cooperating with the input rod to oppose the input signal includes a compression coil spring, the spring extending between the input partition means and the dividing wall and encircling the boss.

10. A fluid actuated positioner as claimed in claim 1 in which:

(a) the input rod has a control surface defining in part the second valve portion and cooperating with the connecting bore of the first valve portion to determine, in part, flow of working fluid through the connecting bore into the second output chamber.

* * * * *